US010201893B2

(12) United States Patent
Hauptmann et al.

(10) Patent No.: US 10,201,893 B2
(45) Date of Patent: Feb. 12, 2019

(54) STRIKING-MECHANISM BODY, STRIKING MECHANISM AND HANDHELD POWER TOOL WITH A STRIKING MECHANISM

(75) Inventors: Udo Hauptmann, Landsberg (DE); Horst Stroissnigg, Puergen (DE)

(73) Assignee: Hilti Aktiengesellschaft, Schaan (LI)

( * ) Notice: Subject to any disclaimer, the term of this patent is extended or adjusted under 35 U.S.C. 154(b) by 1937 days.

(21) Appl. No.: 13/294,304

(22) Filed: Nov. 11, 2011

(65) Prior Publication Data

US 2012/0118597 A1 May 17, 2012

(30) Foreign Application Priority Data

Nov. 12, 2010 (DE) ..... 10 2010 043 837

(51) Int. Cl.
*B25D 17/06* (2006.01)

(52) U.S. Cl.
CPC ..... *B25D 17/06* (2013.01); *B25D 2217/0023* (2013.01); *B25D 2222/06* (2013.01); *B25D 2222/42* (2013.01)

(58) Field of Classification Search
CPC ..... B22D 19/02; B22D 25/06; B22D 47/02; B25B 21/02; B25B 23/0035
USPC ..... 173/90–118, 127, 200–204, 211
See application file for complete search history.

(56) References Cited

U.S. PATENT DOCUMENTS 2,684,383 A 7/1954 Krueger
2,787,984 A 4/1957 Wahlstein
3,114,421 A 12/1963 McCloud et al.
3,295,613 A * 1/1967 Anderson ..... E21B 17/04 173/131
3,640,351 A * 2/1972 Coyne et al. ..... 173/105
3,666,022 A * 5/1972 Bailey et al. ..... 173/80
3,703,093 A * 11/1972 Komatsu ..... B21D 24/16 148/647
3,753,798 A * 8/1973 Komatsu ..... B21J 5/00 148/580
3,952,819 A * 4/1976 Adcock ..... E21B 4/06 173/131
4,044,844 A * 8/1977 Harris et al. ..... 173/73
4,280,540 A * 7/1981 Meacham ..... 144/195.5
(Continued)

FOREIGN PATENT DOCUMENTS

AT 126937 2/1932
DE 727551 11/1942
(Continued)

*Primary Examiner* — Robert Long
(74) *Attorney, Agent, or Firm* — Davidson, Davidson & Kappel, LLC

(57) ABSTRACT

A striking-mechanism body of a handheld power tool at least a first part of the striking-mechanism body, having an impact surface and/or a lateral surface of a first material, and a second part of the striking-mechanism body of a second material, and the first material being more resistant than the second material in terms of at least one material characteristic, the striking-mechanism body being configured as a one-piece steel body so that the first material and the second material are the same, and the first material of the first part body undergoes a heat treatment that differs from that of the second material of the second part of the striking-mechanism body, or the first and the second materials are different, and the first and the second parts are joined together.

23 Claims, 3 Drawing Sheets

(56) References Cited

U.S. PATENT DOCUMENTS 4,323,404 A * 4/1982 Sawada ..... C21D 9/28 148/333
4,499,924 A * 2/1985 Garrett ..... B23P 11/00 138/110
4,527,641 A * 7/1985 Klemm ..... E21B 4/16 173/78
4,629,518 A * 12/1986 Larsen ..... C23C 8/04 101/93.48
4,767,493 A * 8/1988 Mino ..... C21D 1/42 117/10
4,796,799 A * 1/1989 Rasi-Zade ..... B21K 1/76 228/115
4,820,358 A * 4/1989 Chang ..... C22F 1/10 148/410
4,832,764 A * 5/1989 Merz ..... C21D 1/673 148/508
5,050,894 A * 9/1991 Merel ..... F16J 3/047 251/335.3
5,088,638 A * 2/1992 Karaev ..... B23K 20/00 228/112.1
5,161,950 A * 11/1992 Krueger ..... B23K 20/22 29/889
5,291,953 A * 3/1994 Mitchhart ..... E04H 17/263 173/90
5,366,136 A * 11/1994 Pagnon ..... B23K 1/00 228/119
5,407,497 A * 4/1995 Hassan ..... C21D 9/50 148/529
5,467,831 A * 11/1995 Spektor ..... 175/19
5,688,419 A * 11/1997 Offer ..... B23K 9/02 219/137 R
5,735,147 A * 4/1998 Cattanach ..... B60R 25/08 137/382
6,004,311 A * 12/1999 Heilmann ..... C08J 5/121 428/375
6,059,480 A * 5/2000 Maughan ..... F16C 11/0609 403/122
6,223,834 B1 * 5/2001 Takamura et al. ..... 173/93.5
6,244,161 B1 * 6/2001 Myers et al. ..... 92/224
6,379,479 B1 * 4/2002 Ohbayashi ..... C21D 1/09 148/512
6,457,624 B1 * 10/2002 Weihrauch ..... 227/10
7,152,699 B2 * 12/2006 Nordfeldt ..... E21B 17/0426 175/320
7,900,719 B2 * 3/2011 Yao ..... E21B 1/00 175/320
8,101,120 B2 * 1/2012 Juhl ..... C21D 9/0025 138/128
8,696,477 B2 * 4/2014 Huber et al. ..... 470/10
2002/0051695 A1 * 5/2002 Friederich ..... F16B 25/00 411/424
2003/0037849 A1 * 2/2003 Suzuki ..... C21D 1/10 148/565
2003/0057720 A1 * 3/2003 Nees ..... B60R 19/34 293/132
2004/0163484 A1 * 8/2004 Maier ..... F16H 63/30 74/473.36
2004/0179968 A1 * 9/2004 Fukuhara ..... B22F 3/225 418/55.5
2005/0061129 A1 * 3/2005 Berg ..... B21D 37/01 83/658
2005/0095137 A1 * 5/2005 Ganesh ..... B21K 1/10 416/244 A
2005/0163978 A1 * 7/2005 Strobech ..... A61F 5/443 428/195.1
2005/0217901 A1 * 10/2005 Hedlund ..... E21B 17/0426 175/414
2006/0018781 A1 * 1/2006 Woodfield ..... B22F 3/001 419/34
2006/0151188 A1 * 7/2006 Bodine ..... B25B 21/02 173/104
2007/0068605 A1 * 3/2007 Statnikov ..... C21D 10/00 148/558
2007/0236008 A1 * 10/2007 Kim ..... F16L 23/18 285/206
2008/0034961 A1 * 2/2008 Rasmussen ..... 92/172
2008/0128053 A1 * 6/2008 Jansen ..... B23K 26/1411 148/400
2008/0294205 A1 * 11/2008 Greenhalgh ..... A61F 2/958 606/86 A
2009/0320968 A1 * 12/2009 Boeke ..... C21D 1/185 148/546
2010/0083795 A1 * 4/2010 Eggert ..... B23P 15/00 81/52
2010/0155096 A1 * 6/2010 Morrison ..... 173/206
2010/0175234 A1 * 7/2010 Catallo ..... D06C 21/00 26/18.6
2011/0000588 A1 * 1/2011 Bogicevic ..... C21D 1/04 148/559
2011/0124420 A1 * 5/2011 Ooba ..... B23P 15/00 464/146
2011/0154984 A1 * 6/2011 De Oliveira et al. ..... 92/172
2011/0303330 A1 * 12/2011 Ichikawa ..... C21D 1/673 148/645
2012/0048229 A1 * 3/2012 Rasmussen ..... 123/197.2
2013/0180633 A1 * 7/2013 Lee ..... B21D 22/208 148/643
2013/0264123 A1 * 10/2013 Altschuler ..... C21D 8/0236 175/325.2
2015/0096548 A1 * 4/2015 Quinn ..... B25D 17/02 125/41
2015/0196995 A1 * 7/2015 Neitzell ..... B25B 15/002 81/436
2015/0217435 A1 * 8/2015 Vasudeva ..... B25B 23/0035 81/438

FOREIGN PATENT DOCUMENTS

DE 922 038 1/1955
DE 103 044 07 A1 8/2004
JP 819 74 58 A 8/1996
JP 101 69 358 A 6/1998
JP 101 567 57 6/1998
JP 2006 123 025 A 5/2006
WO WO 99/67063 12/1999

* cited by examiner

STRIKING-MECHANISM BODY, STRIKING MECHANISM AND HANDHELD POWER TOOL WITH A STRIKING MECHANISM

This claims the benefit of German Patent Application DE10 2010 043837.5, filed Nov. 12, 2010 and hereby incorporated by reference herein.

The invention relates to a striking-mechanism body, especially to a striker and/or a striking pin of a striking mechanism on a handheld power tool, having a lateral surface and an impact surface by means of which a pulse can be transmitted to a pulse-receiving part, whereby at least a first part of the striking-mechanism body, which has the impact surface and/or the lateral surface, is made of a first material, and especially a neighboring, preferably directly adjacent, second part of the striking-mechanism body is made of a second material, and whereby the first material is configured so as to be more resistant than the second material in terms of at least one material characteristic. The invention also relates to a striking mechanism having a drive that acts directly or indirectly so as to accelerate at least one movable striking-mechanism body having a lateral surface and an impact surface, whereby a pulse of the striking-mechanism body can be transmitted to a pulse-receiving part. The invention also relates to a handheld power tool.

BACKGROUND

A handheld power tool such as a hammer drill, a chisel hammer or a rotary hammer drill or combination hammer, has a striking mechanism that is capable of transmitting a pulse impact at a suitable repeat rate to a tool that is secured in the handheld power tool. For this purpose, the above-mentioned striking mechanism has a drive that acts directly or indirectly so as to accelerate a movable striking-mechanism body such as, for instance, a striker or a striking pin. The drive of the striking mechanism can be configured, for example, with an eccentric wheel mounted on a drive bearing, said wheel causing a piston to execute a stroke motion that then drives the striker, for instance, pneumatically, so that it executes a back-and-forth motion and this, in turn, acts on the striking pin. Therefore, the directly driven striker of the striking mechanism first transmits a pulse impact to the striking pin and then from the striking pin to the shank of the tool.

The striking-mechanism body has a lateral surface and an impact surface. The pulse impact of the striking-mechanism body against the impact surface is regularly transmitted to a pulse-receiving part. The pulse-receiving part can be a tool of the handheld power tool, for instance, a drill bit or a chisel, that receives the pulse impact against the head surface of a tool. Pulse-transmitting impact surfaces serve primarily to transmit pulses between striking-mechanism bodies inside the striking mechanism, in other words, for example, between a striker and a striking pin. Parts of the striking mechanism have to be able to withstand relatively high stresses, especially on an impact surface and/or on a lateral surface.

A striking-mechanism body is known which is made of a case-hardened steel or tempered steel that has been treated, for example, in its entirety by means of case-hardening or tempering or by means of some other heat treatment and that, as such, has identical properties in a single piece along the entire striking-mechanism body, especially also identical properties on the impact surface and on the lateral surface. It has been shown, however, that a striking-mechanism body is exposed in different areas to different stresses, thus making different requirements of the material of the striking-mechanism body. As the energy density in a striking mechanism increases, that is to say, as the ratio of the energy input to the dimensions of a striking-mechanism body increases, the more stringent the requirements become. Thus, for instance, in Japanese laid-open document JP 101 69 358 A, an attempt is made to increase the energy density in a striking mechanism by increasing the specific density of the striking-mechanism body. Even when very high-grade materials and conventional heat-treatment methods are employed for the striking-mechanism body, excessive stresses and premature material fatigue ultimately cannot be avoided at the highest energy densities. The decisive factor is the pulse of a striking-mechanism body—resulting from the velocity and the moved mass—in relation to the resistance of the material of the striking-mechanism body, especially its impact surface and/or lateral surface. Moreover, large striking masses of a striking-mechanism body always translate into a larger installation space for the striking mechanism in terms of its diameter and length, thus leading to larger and possibly disproportionally heavy machines.

For instance, international document WO 99/67063 discloses measures that attempt to reduce the weight of a drive piston for an air-spring striking mechanism in that the piston suspension is made of a plastic material. Moreover, U.S. Pat. No. 3,114,421 or Japanese laid-open document JP 2006 123025 A disclose other measures for adjusting the mass of the striking-mechanism body by selecting different material densities. These measures, however, are inadequate since, on the one hand, only an insufficient bond can be achieved among different masses of parts of the striking mechanism. In any case, on the other hand, the most heavily stressed areas of a striking-mechanism body, namely the impact surfaces and the lateral surfaces, turn out to be insufficiently resistant. Alternatively, Japanese laid-open document JP 8197458 A or German patent application DE 103 044 07 A1 or German document DE 922 038, for example, disclose striking-mechanism bodies having cavities which, when filled with plastic particles or individual particles, have a damping effect on the motion of the striking-mechanism body.

Such measures cannot offset negative effects such as so-called reverberation or the generation of excessive tensile stresses in the tool being used. Negative effects such as, for example, spark discharge as described in Japanese laid-open document JP 10156757 A, can only be prevented to a limited extent in that parts made of a beryllium-copper compound or reinforced plastic are glued or welded onto the colliding parts of a striker and of a striking pin. Such parts cited in JP 10156757 A, however, regularly prove to be insufficiently resistant.

SUMMARY OF THE INVENTION

It would be desirable to improve a striking-mechanism body in terms of the above-mentioned resistance drawbacks.

It is an object of the present invention to provide a striking-mechanism body with which the resistance is improved. In particular, the resistance of a striking-mechanism body is to be improved in particularly heavily stressed areas of a striking-mechanism body such as the impact surfaces and/or the lateral surfaces. In particular, the resistance should be improved without this having a negative effect on the composition of the striking-mechanism body or without causing a disadvantageous limitation in terms of its mass and its dimensions. In particular, it is an objective of the invention to put forward a striking-mechanism body that is configured so as to be resistant in particularly heavily stressed areas, without having to accept negative consequences in terms of the mass and the installation space requirements. In particular, this should be possible even as the striking energy increases. It is also the objective of the invention to put forward an appropriate striking mechanism having at least one striking-mechanism body, especially a striker and striking pin. It is likewise an objective of the invention to put forward an improved handheld power tool.

The present invention provides a striking-mechanism body of the above-mentioned type in which it is provided according to the invention that the striking-mechanism body is configured as a one-piece steel body.

In this context, in a first variant according to the invention, it is provided that the first material and the second material are the same, and that the first material of the first part of the striking-mechanism body undergoes a heat treatment that differs from that of the second material of the second part of the striking-mechanism body. In particular, this heat treatment can be undertaken only for the first material of the first part of the striking-mechanism body. As result, the first material can be imparted with greater resistance than the second material at least in terms of one material characteristic.

In a second variant according to the invention, it is provided that the first and the second materials are different, and that the first and the second parts of the striking-mechanism body are joined together, especially by adhesive force. The second variant likewise yields a striking-mechanism body with a one-piece steel body. Since the first material is configured to be more resistant, a higher resistance can be imparted to the first part of the striking-mechanism body than to the second part of the striking-mechanism body.

In particular, it is optionally also possible in the second variant for only the first material to undergo a heat treatment or to undergo a different heat treatment than the second material. According to the second variant, the first and second different materials can additionally undergo different heat treatments in order to advantageously enhance the effect of the second variant. The first material of the first part of the striking-mechanism body can undergo a heat treatment that differs from that of the second material of the second part of the striking-mechanism body, and the first and the second different materials can be joined to each other by adhesive force.

Based on the concept of the invention, the first part of the striking-mechanism body may comprise the impact surface and/or the lateral surface of the striking-mechanism body. Especially the impact surface and the lateral surface of a striking-mechanism body have proven to be areas of a striking-mechanism body that are particularly heavily stressed.

The invention is based on the notion that a particularly high striking stress is exerted on the pulse-transmitting contact zones between the striking-mechanism body and the pulse-receiving part, in other words, for example, on an impact surface between the striker and the striking pin or on an impact surface between the striking pin and the tool. The striking stress causes impact wear and tear and also entails the risk of surface fatigue, so-called pitting.

Moreover, when it comes to the lateral surfaces, a relatively high high-frequency compressive-tensile alternating stress can be assumed, which makes high requirements in terms of the reverse fatigue strength of a lateral surface, particularly due to notch effects on tapered cross-sectional areas such as gasket grooves and diameter transitions.

On the basis of this consideration, the invention has recognized that the first part of the striking-mechanism body—especially at least the impact surface and/or the lateral surface—is configured with a first material that is resistant in terms of at least one material characteristic so as to meet the requirements. This measure is partially undertaken only for the first part of the striking-mechanism body, while a second part of the striking-mechanism body is configured differently, especially without the cited measure. To put it in simpler terms, the concept of the invention also makes it possible to impart the first part of the striking-mechanism body with a relatively greater resistance than the second part of the striking-mechanism body by configuring the striking-mechanism body as a one-piece steel body, be it as an originally formed one-piece steel body or as a steel body joined by adhesive force.

According to the first variant, this is done in that the first part of the striking-mechanism body undergoes a heat treatment that differs from that of the second part of the striking-mechanism body. This can also mean that only the first part of the striking-mechanism body undergoes a heat treatment. This also means that the first part of the striking-mechanism body undergoes a higher-grade heat treatment, while the second part of the striking-mechanism body undergoes a heat treatment of a relatively lower grade. The terms higher grade and lower grade are to be understood as referring to at least one material characteristic that increases the resistance such as, for example, hardness or toughness. It has also proven to be advantageous to design the second part of the striking-mechanism body to be less resistant, for instance, so as to be relatively elastic or to be able to withstand vibrating stresses.

All in all, the concept of the invention means that the striking-mechanism body may be provided in the form of a one-piece steel body consisting of different materials and/or of identical materials which have undergone different heat treatments. Moreover, partially for particularly heavily stressed areas of a striking-mechanism body, an especially resistant material is provided—be it in the form of an especially resistant first material and/or as a first material that has undergone a particularly advantageous heat treatment.

The concept of the invention also yields a striking mechanism, a striking mechanism in which a striker and/or a striking pin is configured as a striking-mechanism body of the above-mentioned type.

The concept of the invention also yields a handheld power tool having an above-mentioned striking mechanism.

Advantageous embodiments of the invention can give an in-depth presentation of advantageous ways to realize the above-mentioned concept within the scope of the envisaged objective as well as in terms of additional advantages.

Especially preferably, the material characteristic is selected from the group consisting of the following: density, modulus of elasticity, toughness, resistance to wear and tear, strength. Regarding the impact surface, it has proven to be particularly advantageous for the first material to be especially resistant to wear and tear, to be impact-resistant and to have a relatively low modulus of elasticity. In other words, it has proven to be especially advantageous for the first material to have a relatively high resistance to wear and tear, a high level of impact-resistance and/or a relatively low modulus of elasticity. In particular, it has proven to be advantageous for the second material of the second part of the striking-mechanism body to have a relatively high density and a relatively high strength, especially reverse fatigue strength. An especially preferred embodiment of this refinement is described in detail on the basis of the drawing.

Especially when it comes to the first variant according to the invention, it has proven to be advantageous that the other heat treatment of the first part of the striking-mechanism body is tempering and/or carburizing. Nitriding or nitrocarburizing is likewise possible. Other diffusion-based heat treatments in which C or Ni or other alloy components diffuse are also conceivable. Combinations thereof are likewise possible. The type of heat treatment and the selection of the area of the first part of the striking-mechanism body and/or of the second part of the striking-mechanism body for a partial heat treatment can advantageously be carried out on the striking-mechanism body as a function of the requirements.

In an especially preferred refinement of the striking-mechanism body, the one-piece steel body can have at least two different first parts that have undergone the other heat treatment. In particular, two different first parts of the striking-mechanism body can be provided which have undergone different heat treatments. For example, it has proven to be advantageous that a first part of the striking-mechanism body comprises the front impact surface while another first part of the striking-mechanism body comprises the rear impact surface of a striking-mechanism body, each of which has undergone a carburization heat treatment. Yet another first part of the striking-mechanism body that is situated, for example, in-between, advantageously undergoes a tempering heat treatment. This can be used to create a lateral surface of the striking-mechanism body that has especially high reverse fatigue strength.

Thus, the first part of the striking-mechanism body can have a relatively low modulus of elasticity with a relatively high impact resistance and resistance to wear and tear. In particular, the second part of the striking-mechanism body can have a relatively high density with a relatively high reverse fatigue strength. An especially preferred treatment shown by way of an example in the drawing yields an impact surface that is relatively resistant to wear and tear, that is impact-resistant and that has low elasticity and/or it yields a lateral surface of the striking-mechanism body that has especially high reverse fatigue strength.

It is particularly advantageous for the steel of the steel body—preferably the first material of the first part of the striking-mechanism body—to be a steel that has been selected from the group made up of case-hardened steel, tempered steel, tool steel.

Tempered steel generally stands out for its relatively high level of toughness, along with tensile strength. It displays a high fracture resistance, high static and dynamic stressability as well as good hardenability. Typical examples are listed in the standard DIN EN 10083. Typical and characteristic examples are those having a higher content of alloying elements, especially also a higher content of carbon such as, for instance, the tempered steels 36 NiCrNo 16 or 51 CrV6.

Preferably, a tool steel, for instance, a martensite tool steel having a carbon content of more than 0.3%, 0.6%, 0.8% or 1%, can also be provided. This refers especially to steel grades that are suitable for processing or treating materials, such as those described, for example, in standard DIN 17350, augmented by steel grades for plastic processing and tool steels manufactured by means of powder metallurgy. In a first modification, martensite having a relatively high carbon content between 0.6% and 1.6% is advantageously used since it has a very high degree of hardness. A martensite with special carbides having a carbon content between 1% and 2% as well as with up to 12% Cr and alloying elements such as W, Mo, V has likewise proven to be advantageous. Martensites that are highly heat-resistant as well as thermal-shock resistant can also have secondary carbide precipitations with a carbon content between 0.3% and 4%, as well as up to 5% Cr and also the alloying elements Mo, V. A particularly hard martensite that nevertheless exhibits good resistance to wear and tear has primary carbides as well as secondary carbide precipitations with a carbon content of 0.8% to 2% as well as an alloying component of up to 18% (W+2×Mo) and an alloying component of up to 4% V and up to 10% Co.

If necessary, case-hardened steels as non-alloyed or low-alloyed steels having a maximum carbon content of 0.2% have also proven to be advantageous. In particular, with a low carbon content, case-hardened steels can be case-hardened in an atmosphere containing carbon and then tempered, annealed or carburized at temperatures between 880° C. and 1050° C. [1616° F. and 1922° F.]. This makes it possible to achieve a carbon fraction in the edge layer of up to about 0.8%, even in the case of case-hardened steel, so that the hardening on the surface of the striking-mechanism body and/or on the part of the striking-mechanism body is more effective than in the interior. As a result, when case-hardened steels are used with tempering, annealing or carburizing as the heat treatment, a first part of the striking-mechanism body with a high degree of toughness and with a considerably higher hardness on the surface is obtained, thus providing a higher resistance against wear and tear.

Especially advantageously, particularly for the first part of the striking-mechanism body, a material in the form of hard steel, especially as manganese hard steel, can be used. For instance, an X120Mn12-manganese hard steel having a manganese content of 11% to 13% is particularly advantageous. Fundamentally, however, manganese hard steels can also have manganese contents between 11% and 19%. These steels have an initial hardness of approximately 200 HB. Depending on the alloys selected for a given manganese hard steel, on the heat treatment and on the load, it is possible to achieve 450 HB to 600 HB, optionally 650 HB, during operation. Such a so-called cold-hardening austenitic manganese hard steel having high ductility and an excellent cold-hardening capacity obtains its good properties from its combination of the cold-hardening capacity and its ductility. Cold-hardening sets in whenever manganese hard steel is subjected to mechanical stress caused, for example, by an impact or strike, which partially changes the austenite in the surface zone into a martensite. Here, hardness increases of 200 HB to more than 550 HB are possible. In this manner, the hardness, especially of the first part of the striking-mechanism body, rises over the course of use when the part is stressed, for example, on the impact surface. Since the impact surface is also subject to wear and tear caused by friction, the surface layer of the impact surface is constantly eroded, a process in which austenite remains on the surface. Such an austenite, in turn, is converted due to repeated mechanical stress. The alloy that is present under the surface zone is very ductile, as a result of which manganese hard steels can withstand high mechanical impact stress without the risk of fracture. This holds true even for a relatively small size of the impact surface or of the first part of the striking-mechanism body.

Regarding the second variant according to the invention, it has proven to be advantageous to configure the joint as a steel-bonded joint, for instance, as a weld joint. Particularly well-suited weld joints are friction-welded joints created, for example, by rotation friction-welding, linear friction-welding, individual or multi-orbital friction-welding. Especially a multi-orbital friction-welded joint has proven to be advantageous for purposes of welding grades of steel that are normally not weldable such as especially the welding of the manganese hard steel of a first part of the striking-mechanism body to a steel of the second part of the striking-mechanism body.

A joint created by adhesive force can also be created in the form of a soldered joint or a glued joint.

In particular, this does not rule out a partially mechanical joining of the first and second parts of the striking-mechanism body, for instance, by crimping. This advantageously lends itself for the subsequent installation of a protection against wear and tear or the like, especially on the areas subject to impact stress.

The concept of the invention can be particularly utilized with its above-mentioned refinements—be it a refinement of the first variant or a refinement of the second variant, optionally in combination with the first variant—for a striker and/or a striking pin. A striker, for example, as described on the basis of the drawing, can be made of two materials and/or can consist of three separate areas that have undergone different heat treatments. A striking pin can be made, for instance, of two materials and/or can consist of five areas that have undergone different heat treatments.

BRIEF DESCRIPTION OF THE DRAWINGS

Embodiments of the invention will now be described on the basis of the drawing. The drawing does not necessarily depict the embodiments true-to-scale, but rather, the drawing is presented in schematic and/or slightly distorted form whenever necessary for the sake of clarity. Regarding additions to the teaching that can be derived directly from the drawing, reference is hereby made to the pertinent state of the art. In this context, it should be taken into account that a wide array of modifications and changes pertaining to the shape and the detail of the embodiment can be made, without deviating from the general idea of the invention. The features of the invention disclosed in the description, in the drawing as well as in the claims, either on their own or in any desired combination, can be essential for the refinement of the invention. Moreover, all combinations of at least two of the features disclosed in the description, in the drawing and/or in the claims fall within the scope of the invention. The general idea of the invention is not limited to the exact shape or details of the preferred embodiment shown and described below, nor is it limited to an object that would be restricted in comparison to the subject matter claimed in the claims. Regarding the dimensional ranges given, values that fall within the cited limits can also be disclosed as limit values and can be employed and claimed as desired. For the sake of simplicity, the same reference numerals will be used below for identical or similar parts or for parts having an identical or similar function.

Additional advantages, features and individual details of the invention ensue from the description below of preferred embodiments as well as from the drawings; these show the following.

DETAILED DESCRIPTION

Figure 5:
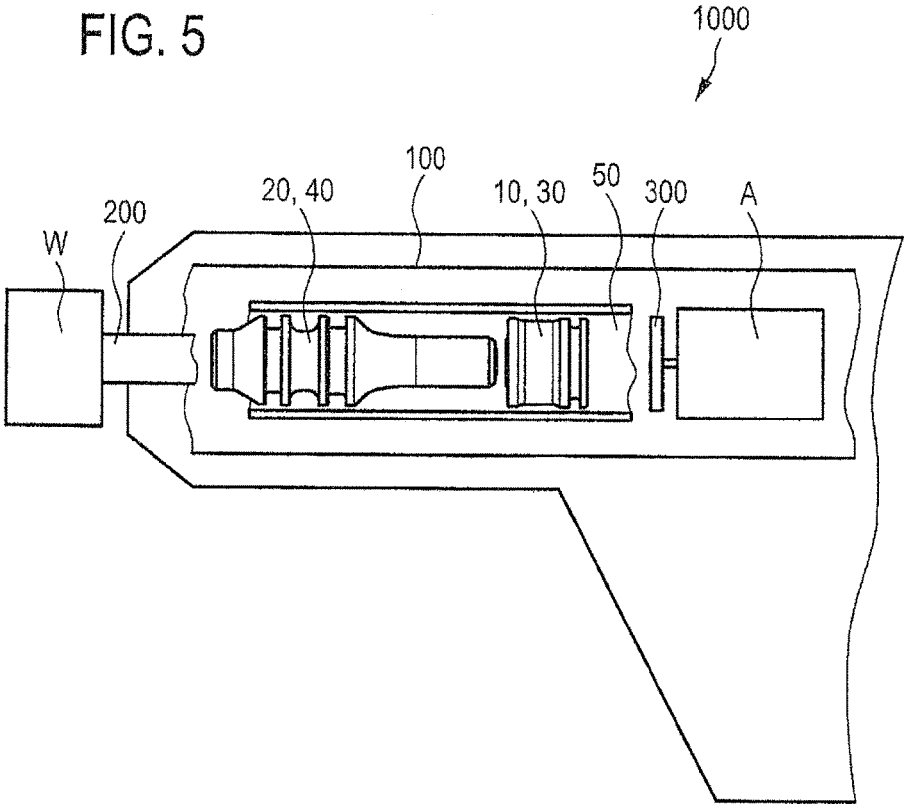
FIG. 5: a schematic depiction of a handheld power tool having a striking mechanism and a tool, whereby the striking mechanism has a striker and a striking pin according to one of FIGS. 1 to 4.

Starting with reference to FIG. 5, it can be seen that said figure schematically shows a handheld power tool 1000 having a striking mechanism 100. The striking mechanism 100, which in the case presented here is configured so as to operate pneumatically, has a schematically depicted drive A. The drive A converts a rotational motion of an electric motor into a back-and-forth motion of a piston 300 which, in turn, acts pneumatically on the striker 10, 30 and causes it to execute a back-and-forth motion. In a guide 50, the striker 10, 30 in turn, transmits its pulse to the striking pin 20, 40 of the striking mechanism 100 via an impact surface not shown in greater detail in FIG. 5. The striking pin 20, 40 transmits its pulse to the shank 200 of the tool W that is held in a receptacle of the tool 1000 not shown in greater detail here.

Figure 1:
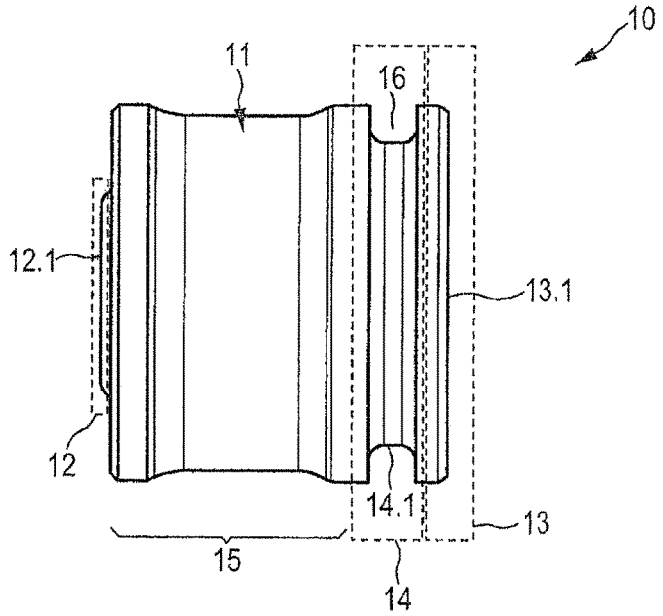
FIG. 1: a striking-mechanism body in the form of a striker which, in a first embodiment according to the first variant of the invention, is configured as a one-piece steel body made of identical steel material but partially having undergone different heat treatments.
Figure 2:
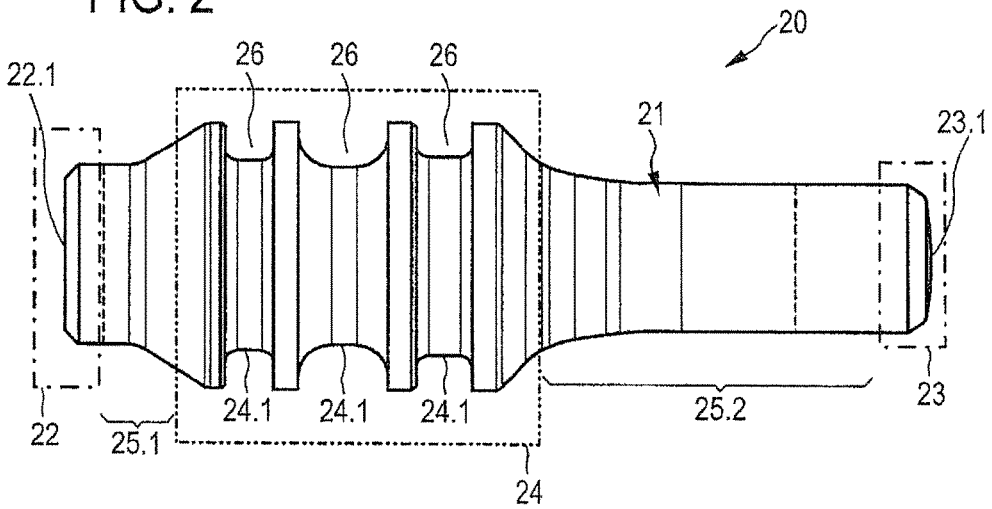
FIG. 2: a striking-mechanism body in the form of a striking pin which, in a first embodiment according to the first variant of the invention, is configured as a one-piece steel body made of identical steel material but partially having undergone different heat treatments.
Figure 3:
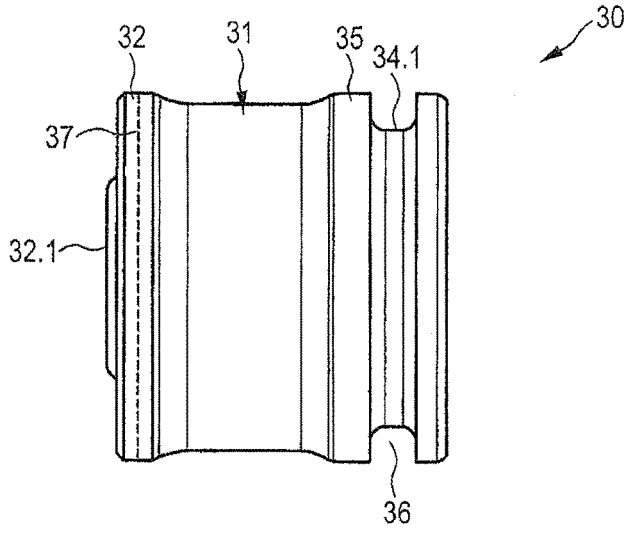
FIG. 3: a striking-mechanism body in the form of a striker which, in a second embodiment according to the second variant of the invention, is configured as a one-piece steel body made of two different materials joined by adhesive force.
Figure 4:
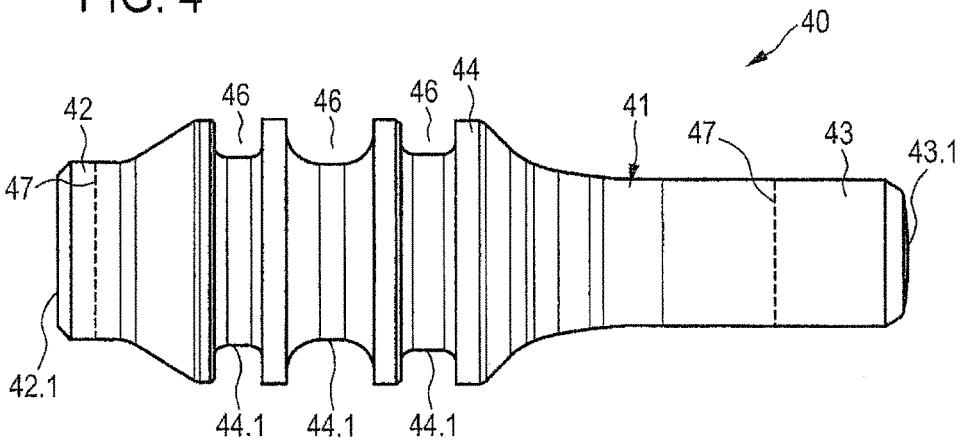
FIG. 4: a striking-mechanism body in the form of a striking pin which, in a second embodiment according to the second variant of the invention, is configured as a one-piece steel body joined by adhesive force from two different materials.

A first embodiment of the striker 10 and of the striking pin 20 is shown in FIG. 1 and FIG. 2 according to the first variant of the concept of the invention. A second embodiment of the striker 30 and of the striking pin 40 is shown in FIG. 3 and FIG. 4 according to a second variant of the concept of the invention.

Now making reference to FIG. 1, it can be seen that said figure shows a striker 10 having a one-piece steel body 11, which in the case presented here, is made of a tempered steel, although, in another embodiment not shown here, it can also be advantageously made of a case-hardened steel. Here, a front first part 12 of the striking-mechanism body is formed on the striking-pin side and a rear first part 13 of the striking-mechanism body is formed on the drive side, said part comprising a front impact surface 12.1 on the striking-pin side and a rear impact surface 13.1 on the drive side. The thus designated front and rear first parts 12, 13 of the striking-mechanism body here have been carburized within the scope of a partial heat treatment for the steel body 11. This results in a particularly effective hardening of the front or rear impact surface 12.1, 13.1. This is particularly advantageous especially in the case of the front impact surface 12.1 since, when in contact with an associated impact surface of the striking pin 20, it transmits the pulse of the striker 10 to the striking pin 20. Both impact surfaces 12.1, 13.1 are thus highly impact-resistant, resistant to wear and tear, and they are configured with a relatively low modulus of elasticity.

In this context, the material of the thus designated first parts 12, 13 of the striking-mechanism body is configured to be more resistant than the other material of the steel body 11 in a second part 15 of the striking-mechanism body that is adjacent to the part 12 or to the part 13. The latter second part 15 of the striking-mechanism body has not undergone a separate heat treatment, but rather, it is formed out of the tempered steel of the steel body 11, which has not undergone a heat treatment. The embodiment of the striker 10 shown in FIG. 1 has another first part 14 of the striking-mechanism body that is formed adjacent to the rear first part 13 of the striking-mechanism body on the drive side and whose tempered steel of the steel body 11 has been partially heat-treated by means of tempering in the area of the other first part 14 of the striking-mechanism body. Here, too, hardening occurs through carbon diffusion which, however, is not as strong as in the previously mentioned first front and rear parts 12, 13 of the striking-mechanism body. On the contrary, in the other first part 14 of the striking-mechanism body, an especially advantageous toughness predominates for this partial area with its lateral surface 14.1 of the striker 10.

FIG. 2 likewise shows an embodiment of a striking pin 20 that falls under the concept of the first variant of the invention, and this striking pin is configured as a one-piece steel body 21 made of tempered steel, and it has a front first part 22 of the striking-mechanism body on the tool side as well as a rear first part 23 of the striking-mechanism body on the striker side and also another first part 24 of the striking-mechanism body. As is the case with the striker 10, the thus designated first front and rear parts 22, 23 of the striking-mechanism body each have a front and rear impact surface 22.1 and 23.1, and they are carburized within the scope of a partial heat treatment in order to impart the front and rear impact surfaces 22.1 and 23.1 with an especially high degree of hardness. The other first part 24 of the striking-mechanism body is tempered within the scope of another partial heat treatment, and this imparts a relatively high level of toughness to this part 24 of the striking-mechanism body and to the lateral surface 24.1. The other areas of the steel body 21, as second parts 25.1 and 25.2 of the striking-mechanism body, are not heat-treated and they exhibit the usual high-quality properties of a tempered steel. As a result, for the striker 10 and the striking-pin 20, the only first parts 12, 13, 22, 23 or 14, 24 of the striking-mechanism body that are carburized or tempered within the scope of a partial heat treatment are those that actually need to have greater strength or toughness, namely, due to the impact surfaces 12.1, 13.1, 22.1 and 23.1 as well as the lateral surfaces 14.1, 24.1 that are present there. In contrast to this, the areas of a second part 15, 25.1, 25.2 of the striking-mechanism body that are exposed to less stress can make do without an additional resistance-enhancing heat treatment.

In greater detail, the other first part 14 and 24 of the striking-mechanism body on the striker 10 and on the striking pin 20 respectively is provided with a plurality of grooves 16, 26 which, as needed, serve to place a gasket or to guide sonic-pressure amplitudes in a guide chamber 50 for the striker 10, 30 and for the striking pin 20, 40. Particularly, the cross sections of the lateral surfaces 14.1, 24.1 which are tapered by the grooves 16, 26 have diameter transitions and are consequently subject to more stringent requirements in terms of their reverse fatigue strength. In view of the more stringent requirements, the present greater toughness of the other first part 14, 24 of the striking-mechanism body prevents fatigue fractures. Such fractures are caused primarily by notch effects at the above-mentioned diameter transitions of the grooves 16, 26. It has proven to be advantageous to counter the notch effect by means of tempering within the scope of a partial heat treatment, especially at least on the greatly tapered areas of the grooves 16, 26.

In summary, when it comes to the present embodiment which uses tempered steel for the one-piece steel body 11, 21 of the striker 10 or of the striking pin 20, the first parts 12, 13, 22, 23 of the striking-mechanism body are carburized within the scope of a partial heat treatment, while the other parts 14, 24 of the striking-mechanism body are tempered.

All in all, a marked improvement of the service life of the striker 10 and of the striking pin 20 can be expected as a result of the targeted adjustment of the material characteristics as a function of the position, and also of the stress of the parts of the striking-mechanism. The striking mechanism 100, which is configured with a striker 10 and a striking pin 20, permits greater energy densities than the striking mechanisms known so far.

In another embodiment not shown here, the steel body 11, 21 of the striker 10 or of the striking pin 20 can be made of case-hardened steel. In this case, it has proven to be advantageous to more strongly carburize the first parts 12, 13 and 22, 23 of the striking-mechanism body. The other first parts 14, 24 of the striking-mechanism body—or at least the grooves 16, 26 that are exposed to a greater notch effect—should be carburized to a lesser degree, but at the very least they should be tempered partially more strongly.

In a modification, it is also possible to employ other heat-treatment methods that are associated with diffusion processes such as nitriding or nitrocarburizing at least for the first parts 12, 13, 22, 23 of the striking-mechanism body and, to a lesser extent, for the other first parts 14, 24 of the striking-mechanism body. As a result, greater hardness can be achieved for the former while especially greater toughness can be achieved for the latter. Other surface-finishing methods are likewise possible such as shot blasting, pelletizing, deep rolling or the like for purposes of further partially influencing especially the above-mentioned first parts 12, 13, 22, 24 of the striking-mechanism body.

FIG. 3 and FIG. 4 show second embodiments of a striker 30 or of a striking pin 40. In the case of the striker 30, the part 32, 35 of the striking-mechanism body are made of different materials. In the case of the striking pin 40, the parts 42, 43 of the striking-mechanism body on the one hand, and 44 on the other hand, are made of different materials. In order to create the striker 30 as a one-piece steel body 31, a first part 32 of the striking-mechanism body and a second part 35 of the striking-mechanism body are joined together at a steel-bonded joint 37. When it comes to the striking pin 40, in order to create a one-piece steel body 41, in each case, a steel-bonded joint 47 is created between a first part 42 of the striking-mechanism body and the second part 44 of the striking-mechanism body, or between a first part 43 of the striking-mechanism body and a second part 44 of the striking-mechanism body. The steel-bonded joint 37, 47 is formed here by a multi-orbital friction-welding joint. As a result, the adjacent parts 32, 31, 35 of the striking-mechanism body in the case of the striker 30 and the parts 42, 44, and 43, 44 of the striking-mechanism body in the case of the striking pin 40 are joined to each other in such a way that, on the one hand, a homogenous bond is created over the entire surface, irrespective of the cross section of the joint, and so that, on the other hand, even materials that are difficult to weld can be joined together. In the case here, the multi-orbital friction-welding at the joints 37, 47 also allows the steel-bonded joining of a manganese hard steel as the first material of the first part 32 or 42, 43 of the striking-mechanism body, and a case-hardened steel as the second material of the second part 35 or 44 of the striking-mechanism body.

Even larger components can be joined with relatively low heat input and virtually independently of the joint geometry in the area of the joint 37, 47 by means of multi-orbital friction-welding. This translates into an additional positive influence on the structure properties owing to plastic deformation during friction welding. In the present case, a first part 32, 42, 43 of the striking-mechanism body is made of a first material in the form of manganese hard steel and consequently, it exhibits a particularly favorable combination of cold-hardening capacity and ductility. This causes the first part 32, 42, 43 of the striking-mechanism body of the striker 30 or of the striking pin 40 to have superior strength and resistance to wear and tear, coupled with a high level of ductility, which is especially beneficial for the creation of impact surfaces 32.1, 42.1 and 43.1 that are highly resistant to wear and tear as well as impact-resistant.

A second part 35, 44 of the striking-mechanism body of the striker 30 or of the striking pin 40 is made here of a case-hardened steel. In a modification not shown here—in a manner similar to that explained with reference to FIG. 1 and FIG. 2—a second part 35, 44 of the striking-mechanism body made of case-hardened steel that serves to increase the toughness on the lateral surfaces 34.1. 44.1 can be tempered within the scope of a partial heat treatment, especially in the area of the grooves 36, 46, which are particularly stressed by notch effects, or else carburized to a small extent in order to increase the toughness in the cited areas.

Altogether, a striker 30 according to the second embodiment of FIG. 3 has a second part 35 of the striking-mechanism body that still has a comparatively high level of reverse fatigue strength with a high density. By the same token, a striker 30 has a first part 32 of the striking-mechanism body that is impact-resistant and resistant to wear and tear with a relatively low modulus of elasticity. Analogously, this holds true for the first parts 42, 43 of the striking-mechanism body or for the second part 44 of the striking-mechanism body of the striking pin 40 of FIG. 4.

What is claimed is:

1. A method for manufacturing a striking-mechanism body of a striking mechanism of a handheld power tool having a lateral surface and an impact surface, a pulse transmittable to a pulse-receiving part via the striking mechanism, the striking mechanism body comprising: at least a first part having the impact surface and/or the lateral surface, the first part being made of a first material; and a second part being made of a second material; the striking-mechanism body being configured as a one-piece steel body, the first material and the second material being the same; the method comprising:

heat treating the first material of the first part of the striking-mechanism body with a heat treatment differing from that of the second material of the second part of the striking-mechanism body.

2. The method as recited in claim 1 wherein the first and second materials are joined at a joint by an adhesive force.

3. The method as recited in claim 1 wherein the heat treatment of the first part is a heat treatment that is selected from the group consisting of tempering, carburizing, nitriding, nitrocarburizing and combinations thereof.

4. The method as recited in claim 1 wherein the second part is tempered.

5. The method as recited in claim 1 wherein the first part of the striking-mechanism body includes shot blast, pelletized or deep rolled finished steel.

6. The method as recited in claim 1 wherein the first material and/or the second material is a steel that is selected from the group consisting of the following: case-hardened steel, tempered steel, tool steel, and hard steel.

7. The method as recited in claim 6 wherein the hard steel is manganese hard steel.

8. The method as recited in claim 2 wherein the joint is a steel-bonded joint.

9. The method as recited in claim 2 wherein the joint created by adhesive force is a weld joint.

10. The method as recited in claim 9 wherein the weld joint is created by friction-welding.

11. The method as recited in claim 10 wherein the friction welding is linear friction-welding, individual or multi-orbital friction-welding.

12. The method as recited in claim 2 wherein the joint created by adhesive force is a soldered joint.

13. The method as recited in claim 2 wherein the joint created by adhesive force is a glued joint.

14. The method as recited in claim 1 wherein the impact surface comprises a planar head surface and/or the lateral surface comprises a tapered cross-sectional area.

15. The method as recited in claim 1 wherein the striking mechanism body is a striker and/or a striking pin.

16. A striking mechanism comprising;

a drive acting to accelerate at least one movable striking-mechanism body manufactured according to the method as recited in claim 1, the striking-mechanism body being configured as a striker and/or as a striking pin.

17. A handheld power tool comprising: a striking mechanism as recited in claim 16; and a shank receiving a pulse from the striking mechanism.

18. The method as recited in claim 1 wherein the first part has a greater hardness than the second part.

19. The method as recited in claim 1 wherein the first part has a lower modulus of elasticity than the second part.

20. The method as recited in claim 1 wherein the first part has a front carburized part and a rear carburized part, the second part being between the front carburized part and the rear carburized part.

21. The method as recited in claim 20 wherein the first part has a further tempered part between the rear carburized part and the second part.

22. The method as recited in claim 1 wherein the second part is not heat treated.

23. The method as recited in claim 1 wherein the second part is heat treated at a lower grade than the heat treatment of the first part.

* * * * *